US006056243A

United States Patent [19]

Prentice

[11] Patent Number: 6,056,243

[45] Date of Patent: May 2, 2000

[54] ADJUSTABLE STRAP FOR A KITE LINE

[76] Inventor: Daniel Prentice, 11483 Lower Colfax Rd., Grass Valley, Calif. 95945

[21] Appl. No.: 09/001,623

[22] Filed: Dec. 31, 1997

[51] Int. Cl.[7] ..... B64C 31/06

[52] U.S. Cl. ..... 244/155 R; 244/155 A

[58] Field of Search ..... 246/153 R, 155 R, 246/155 A; 119/792, 795, 797, 771

[56] References Cited

U.S. PATENT DOCUMENTS

| | | | |
|---|---|---|---|
| D. 165,269 | 11/1951 | Cordell . | |
| 987,963 | 3/1911 | Craig . | |
| 2,472,085 | 6/1949 | Hole . | |
| 2,947,108 | 8/1960 | Dodd et al. . | |
| 3,138,356 | 6/1964 | McClain . | |
| 3,285,546 | 11/1966 | Jalbert . | |
| 3,375,605 | 4/1968 | Gallagher . | |
| 3,409,255 | 11/1968 | Sada . | |
| 3,615,064 | 10/1971 | Gellert . | |
| 3,740,010 | 6/1973 | Curtis . | |
| 3,746,286 | 7/1973 | Christoffel . | |
| 3,873,051 | 3/1975 | Kennedy . | |
| 4,014,477 | 3/1977 | Hyun . | |
| 4,101,090 | 7/1978 | Wait, Jr. . | |
| 4,129,273 | 12/1978 | Hill . | |
| 4,172,567 | 10/1979 | Post . | |
| 4,176,806 | 12/1979 | Kwon . | |
| 4,278,212 | 7/1981 | Wesley . | |
| 4,714,217 | 12/1987 | Prentice . | |
| 5,120,081 | 6/1992 | Longoria et al. . | |
| 5,161,486 | 11/1992 | Brown | 119/797 |
| 5,417,390 | 5/1995 | Southwick | 244/155 A |
| 5,511,746 | 4/1996 | Hostetter | 244/155 A |
| 5,749,325 | 5/1998 | Albanese | 119/797 |
| 5,806,467 | 9/1998 | Arakawa | 119/797 |

FOREIGN PATENT DOCUMENTS

| | | | |
|---|---|---|---|
| 2385422 | 3/1977 | France . | |
| 461102 | 6/1928 | Germany | 119/797 |

OTHER PUBLICATIONS

Undated advertisement for String Along Stunt Kite String Winder.

1997 Catalog of the Shanti Kite Company, pp. 12–13.

"Good Grips," an advertisement in *Kite Lines* vol. 8, No. 1, Summer 1990, p. 67.

"Peter Powell Kites," an advertisement in *Kite Lines* vol. 7, No. 1, Spring 1988.

An undated advertisement for "BOA's Convertible Strap," published in *KIte Lines*.

An undated advertisement for "BOA's Convertible Wrist Straps," published in *Kite Lines*.

"Always Follow These Safety Rules," a paper published by the Shanti Kite Company in 1996.

*Primary Examiner*—Galen L. Barefoot

*Attorney, Agent, or Firm*—Finley & Berg, L.L.P.

[57] ABSTRACT

A variable-length, adjustable strap for use with a kite line is provided which comprises a strip of material forming a looped portion and adjustment means allowing the length of the strap to be adjusted. Affixing means mounted upon the strip of material are provided to which a kite line can be detachably attached.

11 Claims, 4 Drawing Sheets

16
18
330
310
346
332
340
344

16
18
330
346
340
344
332
338
310

16
18
440
452
450
431
448
430
432
410
438

ADJUSTABLE STRAP FOR A KITE LINE

FIELD OF THE INVENTION

This invention relates to apparatus for controlling kites.

BACKGROUND OF THE INVENTION

Kite flying is an enjoyable sport which has become popular in a wide variety of modes. Kite flying ranges from a child's first attempt to launch a traditional diamond-shaped kite, to an artist's exhibition of an immense, elaborately decorated kite controlled by a large number of kite lines, to a sport kite competitor's duel with other kite flyers using a highly responsive, streamlined kite.

The key to successful control of a kite's flight lies in the kite flyer's ability to manipulate the kite lines connecting the kite to the flyer. For competitive kite flying, such as sport kiting, the ability to make instantaneous adjustments of the kite lines is crucial to competition. Artistic kites may not be shown to full advantage if their kite lines cannot be adequately controlled to cause the kite to follow an appropriate course. And even the casual kite flyer is more likely to enjoy his pursuit if the kite can be zipped along a path at the flyer's whim.

While it is possible to control kite lines by simply gripping the kite lines in the hands, this may prove uncomfortable and poses the risk that the kite line may simply slip through the fingers, allowing the kite to escape. Some kites, such as those utilizing para-foil wings, may apply hundreds of pounds of pull on the kite line, making it difficult to control the kite line without an aid.

Accordingly, over the years, an assortment of kite line handles and controllers have been developed to aid kite flyers in managing their kite lines. These devices have been as simple as a band of fabric looped about the hand or fingers, and as complicated as multiple spool trigger-controlled kite line reels. Many of these devices have been oriented towards allowing the user to let out a kite line or lines rapidly while the kite is being launched and to reel the kite line or lines in rapidly when the kite is brought in.

Sport kite flyers have generally used simple kite handles because they are easy to hold and move about, and because sport kite flyers usually use kite lines of equal, fixed length (typically 75 to 150 feet) and let out the full kite line while flying the kite, making complicated reeling systems unnecessary. Where the kite lines are of exactly equal length, a sport kite flyer can quickly and accurately manipulate the kite simply by moving the end of a kite line in relation to the ends of the other lines.

While the kite lines are commonly manipulated in the hands, alternatives exist: for example, a kite flyer can control a four line kite by holding two lines in the hands and attaching two of the kite lines at the flyer's hips, such that the flyer can manipulate the kite by moving the hands and rotating the hips.

Several common characteristics of kite lines, called "stretching" and "creeping," interfere with the kite flyer's ability to maintain the kite lines at equal lengths. "Stretching" refers to temporary lengthening of the kite lines while the kite is in flight due to the load of the kite on the line. "Creeping" refers to the line's inability to return to its original length after use. Because both stretching and creeping alter the length of the kite lines, most kite lines today are made of high modulus fibers that demonstrate minimal stretching and creeping, such as Spectra™ or Kevlar™. Even such competition-caliber, high quality kite lines exhibit sufficient stretching and/or creeping that adjustment of the length of each line must be possible to ensure proper control of the kite. Simply cutting the kite lines is undesirable because it is time consuming, potentially poses the risk of unravelling the kite line if it is twisted or braided, and may require numerous cuts to accurately adjust the kite, eventually eating up the kite line. Reknotting the kite string to alter the length is time consuming in any instance, and is particularly inefficient where the knots are sleeved. (Lines made of high modulus fibers have poor knot strength, requiring flyers to sleeve the knots where they knot them). A better approach to altering the line length is to adjust the kite line length at the kite line handle or control.

Existing kite line handles frustrate careful kite line control by failing to allow individual movement of each kite line, by incorporating unwieldy spools or reels into the handle, or by failing to provide a simple, accurate means to adjust the effective length of each kite line along a continuum. A need exists for a kite line handle which is inexpensive and easily manipulated, which can be attached easily at a user's hands or at other locations, and which allows a user to quickly and accurately adjust the kite line's effective length to whatever length is required.

SUMMARY OF THE INVENTION

The present invention fulfills that need by providing a variable-length, adjustable strap for use with a kite line. The inventive adjustable strap comprises a strip of material forming a looped portion, and adjustment means for adjusting the length of the strap. Affixing means mounted upon the strip of material are provided to which a kite line can be detachably attached.

A primary object of the current invention is to provide an adjustable strap whose length can be adjusted quickly and easily by a kite flyer, thereby adjusting the effective length of a kite line attached to the kite line strap.

Another object of the current invention is to provide an adjustable strap which is simple and inexpensive to produce.

A further object of the current invention is to provide a kite line control which is easily manipulated and is not unwieldy.

Yet another object of the current invention is to provide a strap for a kite line which can easily be fixed about a variety of objects including but not limited to a kite flyer's hand or a belt loop.

Other objects and advantages of the present invention will become apparent when the adjustable kite line strap of the present invention is considered in conjunction with the accompanying drawings, specification, and claims.

DESCRIPTION OF THE PREFERRED EMBODIMENT

The present invention solves the stated problems by detachably attaching a kite line to an affixing means on an inventive adjustable kite line strap. The inventive strap utilizes a strip of material which forms a looped portion which can easily be wrapped around a kite flyer's wrist, or alternatively can be fed through, looped around, or tied to other desired places of attachment, such as a belt loop, or to the kite itself (not shown). An adjustment means on the inventive strap allows the user to lengthen or shorten the circumference of the loop. By adjusting the circumference of the loop, the effective length of the strap is increased or decreased. (Which effect will occur in response to lengthening or shortening the circumference will depend on the placement of the affixing means). Where multiple kite lines of equal effective length are required, each kite line may be fixed to an inventive strap, and each strap can then be individually adjusted until the effective lengths of each strap and kite line combination are equal. Alternatively, the kite flyer may employ one strap of fixed length along with any number of inventive straps, as the inventive straps may be adjusted to match with the fixed length strap and kite line.

Figure 1:
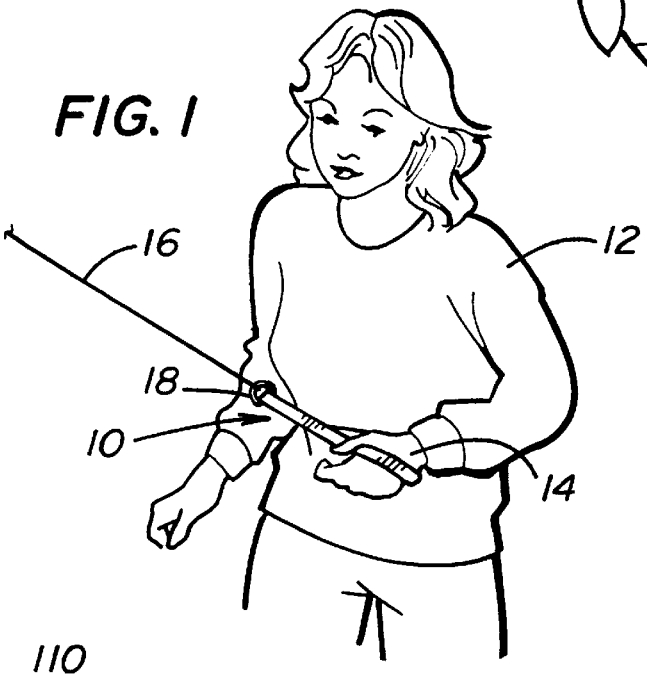
FIG. 1 is a front perspective view showing an inventive adjustable strap with a kite line attached as worn by a kite flyer.

FIG. 1 depicts a first preferred embodiment of the inventive adjustable kite line strap 10 as used by a kite flyer 12 and worn about the flyer's hand and wrist 14. Kite line 16 is detachably fastened at one end to an affixing means 18, here a D-ring, fastened on the strap 10; the other end of the kite line extends up to attach to a kite (not shown).

Figure 2:
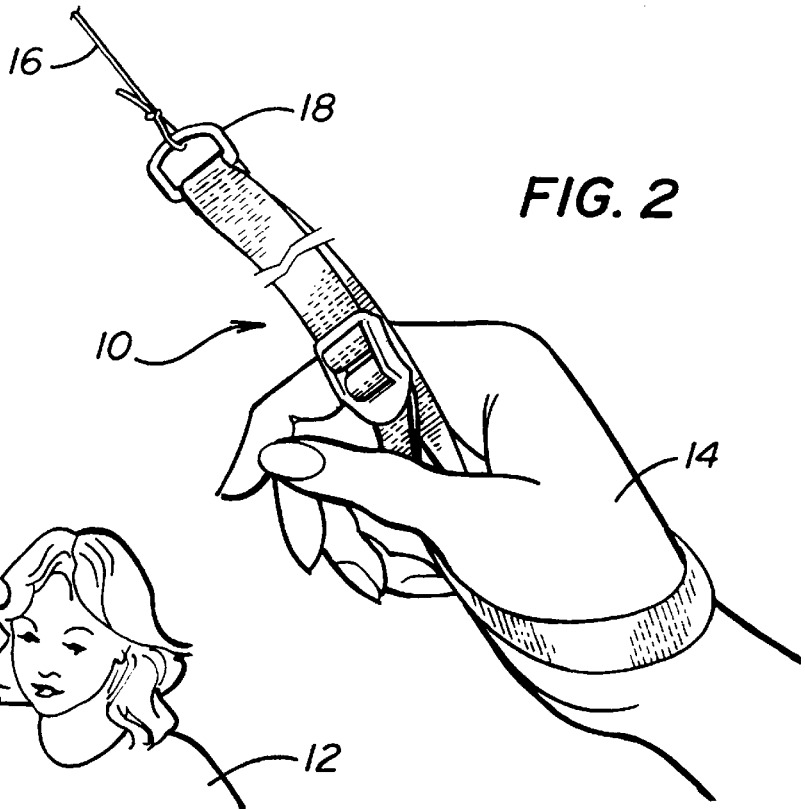
FIG. 2 is an exploded detailed view of the adjustable strap as worn about the kite flyer's hand.

FIG. 2 shows a preferred method for wearing the strap 10 about the flyer's hand and wrist 14. Any comfortable arrangement can be used: for example, the strap may simply be fastened over the palm, as shown in FIG. 1, or attached to other devices manipulated by flyer 12 or at other places on the flyer's body than the hand. However, the configuration depicted in FIG. 2 braces the strap about the wrist and allows for easy control of the kite line with little movement of the hand.

Figure 3:
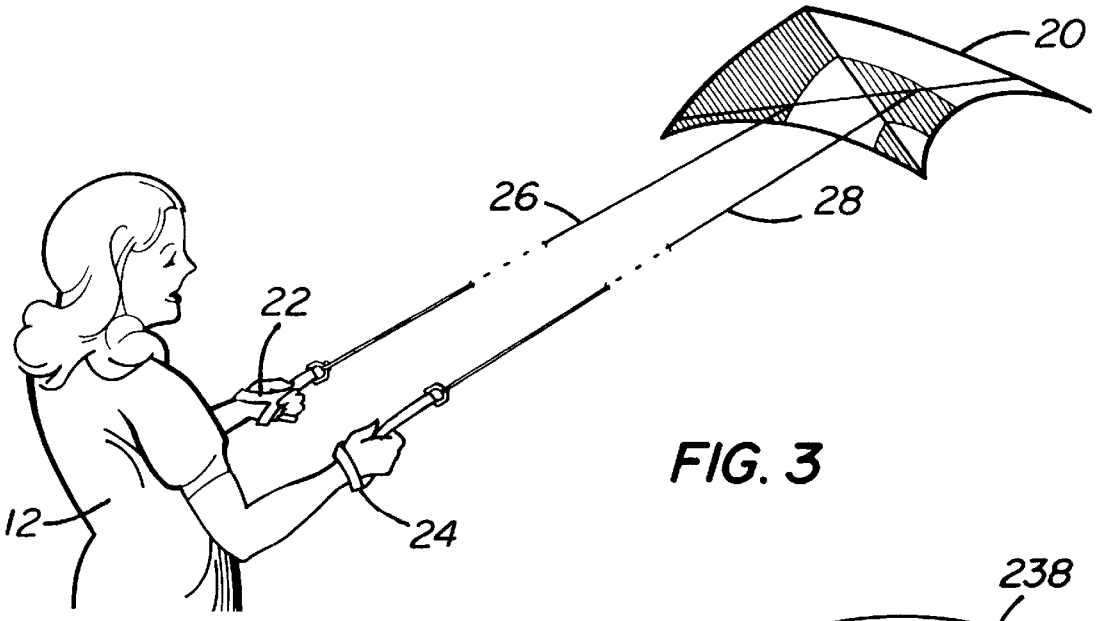
FIG. 3 is a perspective view of a standard twoline kite being controlled by the kite flyer using kite lines attached to two of the adjustable straps.

FIG. 3 shows flyer 12 controlling a typical two-line sport kite 20 using two inventive straps 22 and 24. In FIG. 3, kite line 26 has undergone more creeping than kite line 28; accordingly, flyer 12 has adjusted inventive strap 22 to have a length shorter then the length of inventive strap 24, such that the length of strap 22 and kite line 26 equals the length of strap 24 and kite line 28. This affords flyer 12 with the best control of kite 20.

Referring to FIGS. 4, 9, 9A, and 9B, a first, preferred embodiment of strap 10 is shown apart from flyer 12. A first end 30 of a strip of material 32 is fixed about a first inner leg 33 of a continuously adjustable slide buckle 34 and sewn to itself at 37. Strip of material 32 is then fed through affixing means 18 and again sewn to itself at 37, forming a fixed band 36 of set length between buckle 34 and affixing means 18 which cannot be moved through buckle 34. A kite (not shown) is attached to kite string 16, which is detachably fixed to affixing means 18. The rest of strip of material 32 is then looped around back to buckle 34, forming a looped portion 38. The second end 40 of strip of material 32 is brought through buckle 34 and around a second inner leg 35 of buckle 34 to the outside of looped portion 38, as is most clearly shown in FIG. 9. The length of the strap in the first, preferred embodiment can be adjusted by changing the length of looped portion 38 by moving second end 40 in relation to buckle 34: if second end 40 is lengthened, the circumference of looped portion 38 is lessened, shortening the effective length of strap 10 and thus of kite line 16 in combination with strap 10; if second end 40 is shortened, the effective length of strap 10 is similarly lengthened. Barbs 31 on the underside of buckle 34 prevent inadvertent motion of second end 40 in relation to buckle 34.

The advantage of fixing in place strip of material 32 at band 36 is that the load exerted by the kite cannot move strip of material 32 through buckle 34 to alter the length of strap 10. However, it will be shown in the further embodiments that such fixture of strip of material 32 is not necessary, and may not be desired if greater flexibility of adjustment of strap 10 is desired.

Figure 5:
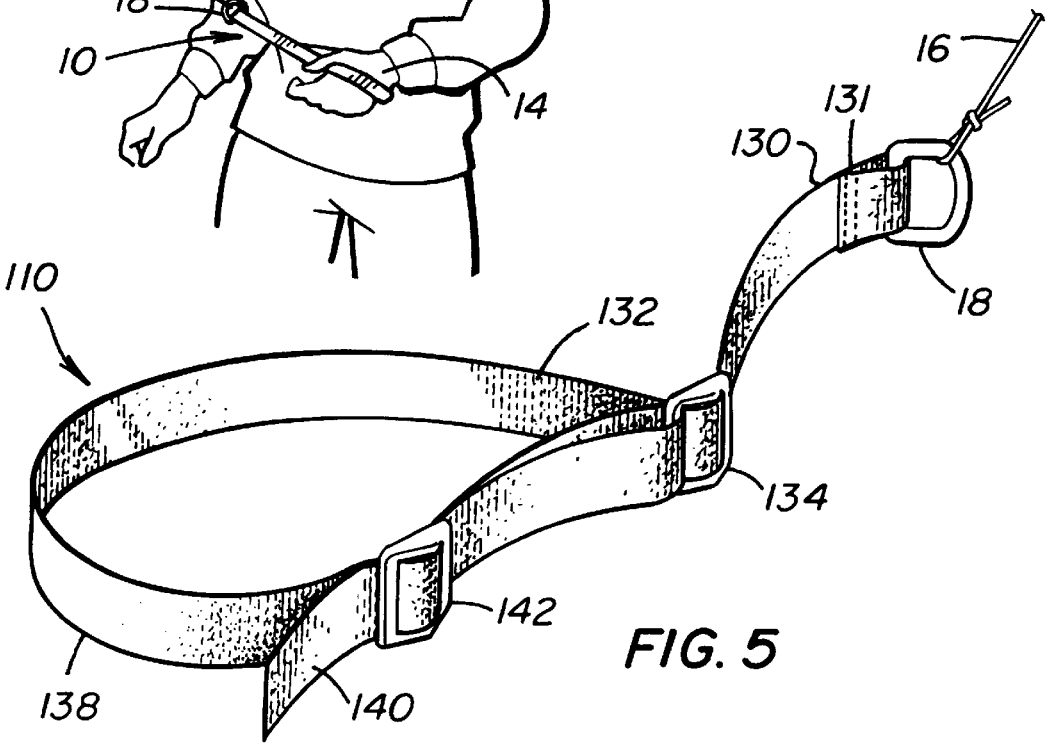
FIG. 5 is a perspective view of an alternate embodiment of the inventive adjustable strap.

While many other embodiments of the inventive adjustment kite line strap are possible, four other alternate embodiments are shown and described herewith. FIG. 5 depicts a first alternate embodiment of the inventive adjustable strap 110 in which the body of strap 110 is again formed from a strip of material 132, a continuous adjustable slide buckle 134 which allows adjustment of the length of strap 110, a looped portion 138, a first end 130 extending away from looped portion 138, and a second end 140, here fed through buckle 134 such that end 140 is adjustable through buckle 134, extends outside of looped portion 138, and is preferably held against looped portion 138 by buckle 142. Note that where additional buckle 142 is used to secure second end 140 as here, a buckle with only one inner leg can be used, and second end 140 may simply be wrapped around an edge of buckle 134. D-ring 18, used to detachably attach kite line 16 to strap 110, is fixed at the terminal end of first end 130, which can be done by feeding first end 130 through affixing means 18 and then sewing first end 130 back to itself at 131.

In the first alternate embodiment, strip of material 132 is not fixed to itself between buckle 134 and affixing means 18. This allows the user to alter the length of strap 110 by maneuvering either first end 130 or second end 140 through buckle 134, providing high flexibility. However, care should be taken that buckle 134 has sufficient strength to hold strip of material 132 in place against the expected load exerted by the kite, so that the strap does not inadvertently change length. Note also that because strap 110 can be adjusted at first end 130 in this embodiment, second end 140 could be fixed to looped portion 138 after passing through buckle 134.

In the first alternate embodiment, to shorten the circumference of looped portion 138, end portions 130 and/or 140 may be pulled through buckle 134 away from looped portion 138. Pulling end portion 130 through buckle 134 away from looped portion 138 will increase the effective length of strap 110 because it will increase the length of end portion 130 more than it will decrease the effective length of looped portion 138; conversely, pulling end portion 140 through buckle 134 away from looped portion 138 will decrease the effective length of strap 110 by shortening the effective length of looped portion 138. The opposite adjustments of strap 110 may be made by pulling the end portions back in towards looped portion 138.

Figure 6:
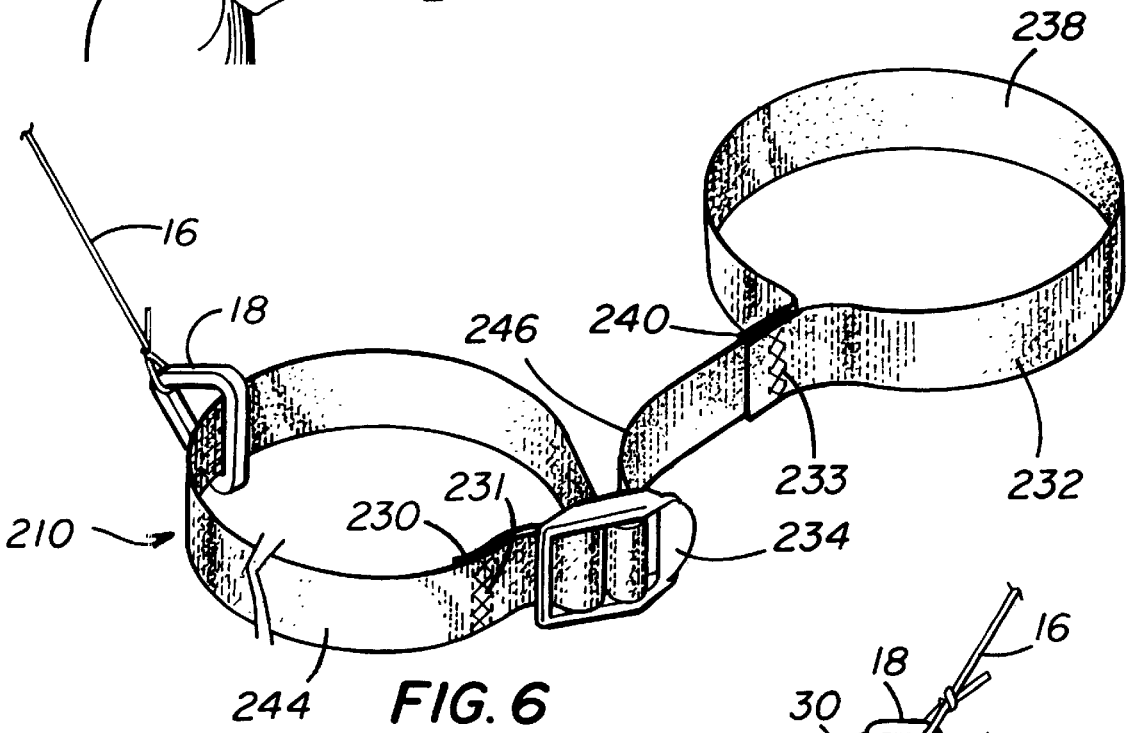
FIG. 6 is a perspective view of a second alternate embodiment of the inventive adjustable strap.
Figure 4:
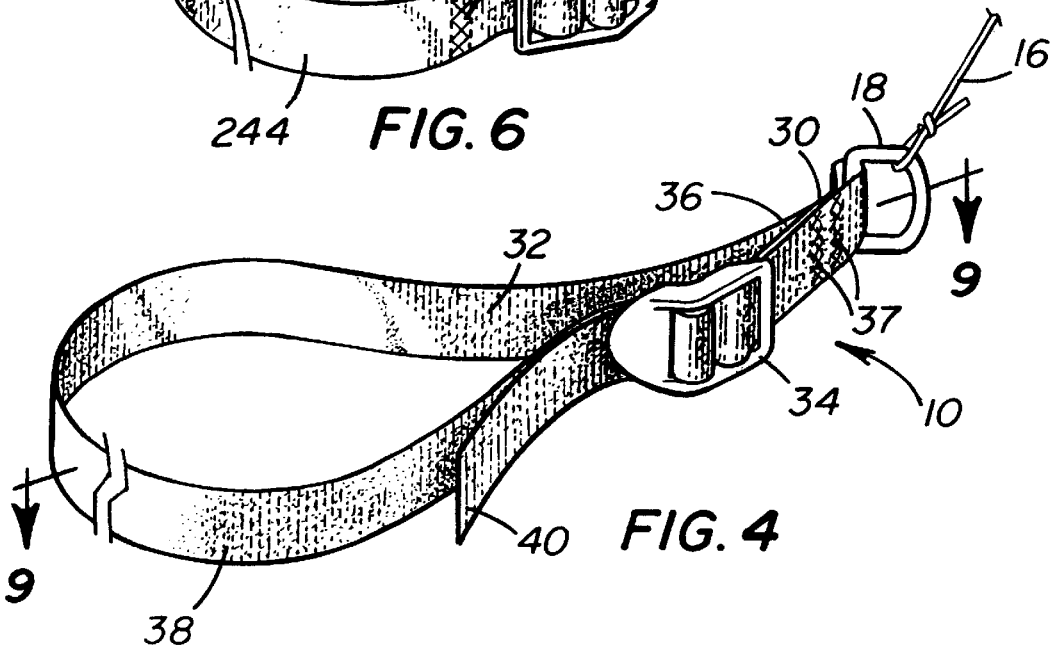
FIG. 4 is a perspective view of a preferred embodiment of the inventive adjustable strap.

In the second alternate embodiment, shown in FIG. 6, an inventive adjustable strap 210 is formed from a strip of material 232 having ends 230 and 240 is formed into two looped portions 238 and 244. First looped portion 238 forms a handle of a fixed size, which may be done by sewing end 240 back to strip of material 232 at 233. End 230 of strip of material 232 is fed around a first leg of a continuously adjustable slide buckle 234, through affixing means 18, and then formed into looped portion 244 by feeding end 230 back around a second leg of buckle 234 to the inside of looped portion 244. End 230 is then fixed back to looped portion 244 at 231, as by sewing. A connecting section 246 of strip of material 232 then links looped portion 238 to looped portion 244. The length of strap 210 can then be adjusted by manipulating connecting portion 246 through buckle 234. This embodiment provides the user with the advantage of a constant-size handle (238) and places the adjustment means for strap 210 between the looped portion serving as a handle and the affixing means 18. It should be noted that in this embodiment affixing means 18 should not be fixed to looped portion 244, but should be movable along looped portion 244, so that when the size of looped portion 244 is altered, affixing means 18 may be moved to the desired position.

It should also be noted that, while the length adjustment means of the invention is preferably incorporated into the handle used by the kite flyer, it is possible to attach a simple handle to the kite line at the kite flyer's end and mount an adjusting means on the kite or even in the middle of the kite line for adjusting the total length of the handle, kite line, and adjusting means. For example, in the second alternate embodiment depicted in FIG. 6, connecting portion 246 could effectively be replaced by the kite line, and looped portion 244 could be attached to the kite or even attached between sections of kite line. Looped portion 244 would be adjustable through buckle 234 to change the effective length of the two-part apparatus in combination with the kite line.

Figures 7, 7A, 8:
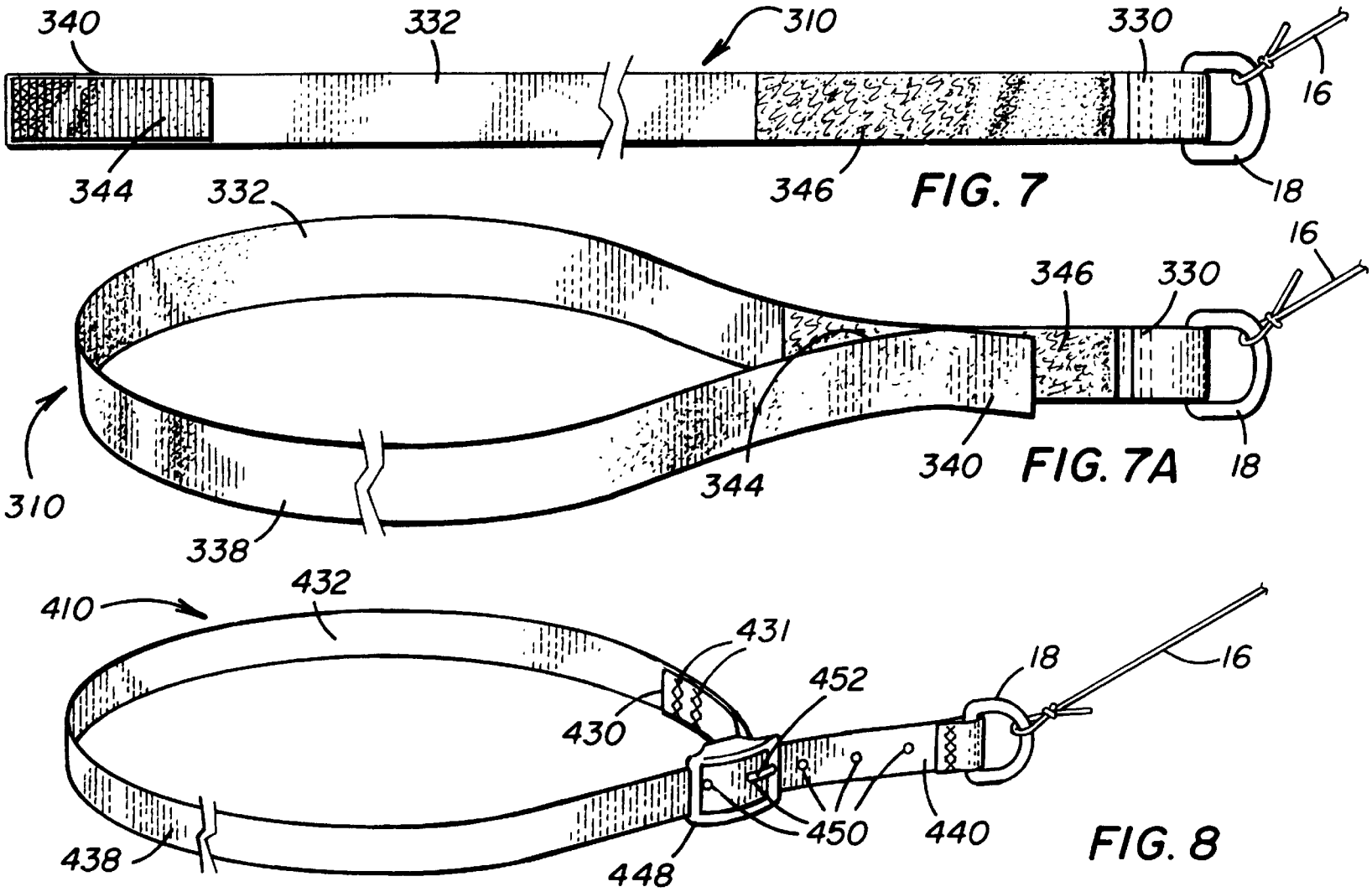
FIG. 7 is a perspective view of a third alternate embodiment of the inventive adjustable strap in its unfastened position.
FIG. 7A is a perspective view of the third alternate embodiment of the inventive adjustable strap in a fastened position.
FIG. 8 is a perspective view of a fourth alternate embodiment of the inventive adjustable strap.
Figure 9B:
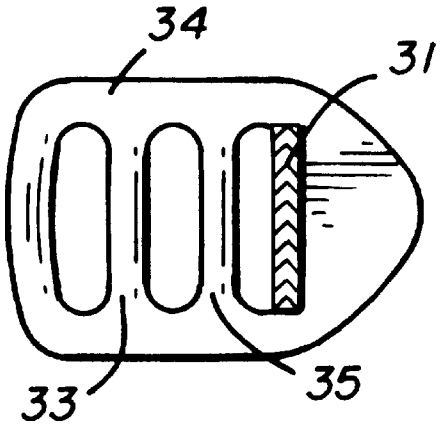
FIG. 9B is a bottom plan view of the buckle used in the preferred embodiment of the inventive adjustable strap of FIGS. 4 and 9.
Figure 9A:
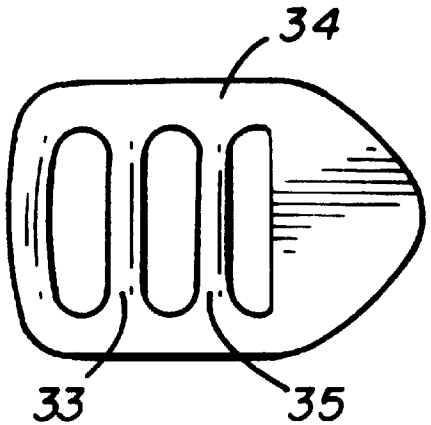
FIG. 9A is a top plan view of the buckle used in the preferred embodiment of the inventive adjustable strap of FIGS. 4 and 9.
Figure 9:
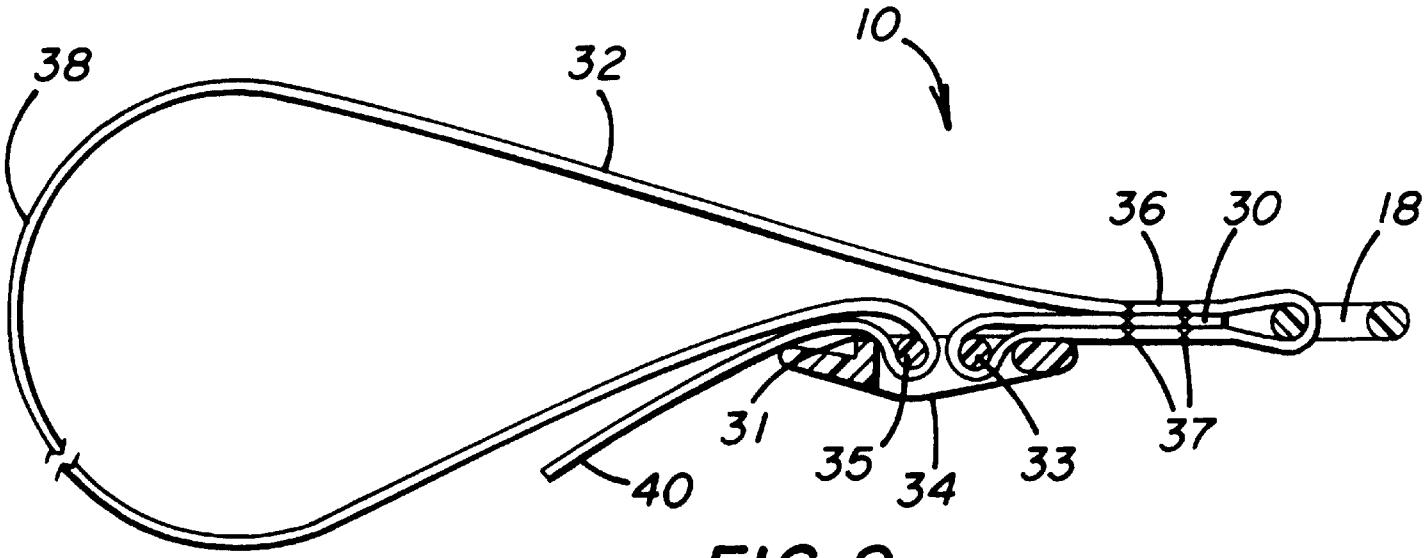
FIG. 9 is a side cross sectional view of the preferred embodiment of the inventive adjustable strap of FIG. 4 taken at section line 9—9.

A third alternate embodiment of the inventive adjustable kite line strap 310 is shown in FIGS. 7 and 7A, and demonstrates how the present invention can utilize fabric hook and eye fasteners, including devices such as Velcro®, snaps, and hook and loop combinations. Affixing means 18 here is attached to a first end 330 of a strip of material 332. One strip 344 of the fabric hook and eye fastener (shown in FIG. 7 as the fabric hooks) is fixed to second end 340 of strip of material 332, and the corresponding strip 346 of the fabric hook and eye fastener (shown in FIG. 7 as the fabric eyes) is fixed on the same side of strip of material 332 a small distance from affixing means 18. In use, the fourth embodiment is employed as shown in FIG. 7A. A looped portion 338 is formed by attaching strip 344 to strip 346 in the usual fashion of fabric hook and eye fasteners. The length of looped portion 338, and accordingly the length of the fourth strap embodiment 310, is adjusted by altering where the two strips 344 and 346 are overlapped and fastened. Preferably, the lengths of strips 344 and 346 differ such that the shorter strip can completely mesh with the longer strip along a range of positions along the longer strip.

It should be noted that fabric hook and eye fasteners can be used to replace other fastening means for the inventive strap. For example, buckle 142 shown in FIG. 5, used to hold end 140 against looped portion 138, could be replaced with a fabric hook and eye fastener pair.

FIG. 8 depicts a fourth alternate embodiment of the inventive adjustable kite line strap 410 in which a belt-type buckle 448 is employed. A first end 430 of a strip of material 432 is passed around an inner leg (not shown) of tongued buckle 448 and fixed back upon strip of material 432 at point 431. Strip of material 432 is then looped back about to tongued buckle 448 to form looped portion 438. A series of buckle holes 450 are spaced apart along the length of second end 440. Kite line 16 is detachably attached to affixing means 18 which is fixed to the second end 440 of strip of material 432. The effective length of looped portion 438 can then be adjusted by changing the length of end 440 through buckle 448, fitting the tongue 452 of tongued buckle 448 through the appropriate one of buckle holes 450. Alternatively, rather than D-ring 18, the affixing means can simply be one of buckle holes 450. Kite line 16 may be tied through that buckle hole; the length of the kite line 16 and strap 410 may still be adjusted by changing the length of end 440 through tongued buckle 448 and fitting tongue 452 through one of the other buckle holes 450.

For each of the embodiments described, it should be understood that the material used for strip of material 32 can be of any suitable material that is durable and sufficiently flexible such that it may readily be looped, or passed through an adjustment means such as buckle 34 or tongued buckle 48. The "strip of material" can actually be formed from several smaller pieces of material as long as those pieces are fastened together such that they act as a single strip. Thus, looped portion 238 of the second alternate embodiment shown in FIG. 6 could be made of a separate piece of material than looped portion 244 as long as those pieces were securely fastened together, for example if sewn together at point 233.

It should further be understood that any adjustment means can be used which allows adjustment by the flyer but also holds the strap in the adjusted position while reasonable force is applied to the strap (e.g., by the kite), including but not limited to buckles, clips or clamps, hook and eye fasteners, etc. Similarly, the affixing means used can be any apparatus to which the kite line can be detachably fixed, including but not limited to rings of all shapes, fabric loops, line clips or clamps, and so forth.

Although the foregoing invention has been described in some detail by way of illustration for purposes of clarity of understanding, it will be readily apparent to those of ordinary skill in the art in light of the teachings of this invention that certain changes and modifications may be made thereto without departing from the spirit or scope of the appended claims.

It is claimed:

1. An adjustable strap and kite line assembly having a variable length, the adjustable strap and kite line assembly comprising:

a strip of material forming a looped portion having a length such that said looped portion can be secured about a user's wrist;

adjustment means associated with said strip of material and operable to continuously adjust said variable length of said adjustable strap and kite line assembly;

a kite line; and affixing means mounted upon said strip of material for detachably attaching said kite line such that when said looped portion is secured about a user's wrist, the variable length of said adjustable strap and kite line assembly can be securably adjusted to change the length of the portion of said adjustable strap and kite line assembly which extends away from said user's wrist.

2. The assembly of claim 1, wherein said adjustment means comprises a continuously adjustable slide buckle and wherein said strip of material adjustably passes through said continuously adjustable slide buckle.

3. The assembly of claim 2, wherein said continuously adjustable slide buckle is fixed to said strip of material at a first fixture point and said affixing means is fixed to said strip of material at a second fixture point, said first and second fixture points defining a fixed portion of said strip of material between them having a defined length, such that said fixed portion is non-adjustable through said continuously adjustable slide buckle.

4. The assembly of claim 2, wherein said strip of material defines a first end and a second end, and wherein said affixing means is fixed to said strip of material at said first end.

5. The assembly of claim 4, wherein said second end extends from said buckle and is movable through said buckle for adjustment of said length of said strap, and further comprising a second buckle, said second buckle mounted upon said looped portion and movable along said looped portion, said second buckle detachably fixing said second end of said strip of material to said looped portion.

6. The assembly of claim 2, wherein said looped portion is a first looped portion, wherein said affixing means is movable along said first looped portion, and wherein said strip of material further forms a second looped portion having a fixed circumference.

7. The assembly of claim 1, wherein said adjustment means comprises a fabric hook and eye fastener.

8. The assembly of claim 7, wherein said strip of material defines an upper side, a first end, and a second end, wherein said fabric hook and eye fastener comprises a strip of fabric hook material attached proximate said first end of said strip of material and a strip of fabric eye material attached to said second end of said s trip of material, and wherein said looped portion is adjustably formed by meshing said strip of fabric hook material with said strip of fabric eye material such that they at least partially overlap.

9. The assembly of claim 1 further comprising a kite and wherein said kite line has a first end detachably attached to said affixing means and a second end detachably attached to said kite.

10. The assembly of claim 1 further comprising a kite and wherein said strip of material is detachably attached to said kite, said kite line has a first end and a second end, said first end of said kite line is attached to said affixing means, and said second end of said kite line extends away from said kite.

11. A variable-length adjustable strap for use with a kite line, the strap comprising:

a strip of material forming a first looped portion and a second portion extending away from said first looped portion;

adjustment means associated with said strip of material and operable to continuously adjust the lengths of said first and second portions of said strip of material simultaneously; and affixing means mounted upon said second portion of said strip of material for detachably attaching a kite line.

* * * * *